US007716851B2

(12) United States Patent
Polegato Moretti

(10) Patent No.: US 7,716,851 B2
(45) **Date of Patent: *May 18, 2010**

(54) WATERPROOF AND BREATHABLE SOLE FOR SHOES

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/056,901

(22) Filed: Mar. 27, 2008

(65) Prior Publication Data

US 2008/0209769 A1 Sep. 4, 2008

Related U.S. Application Data

(63) Continuation of application No. 10/529,187, filed as application No. PCT/EP03/10395 on Sep. 18, 2003, now Pat. No. 7,367,141.

(30) Foreign Application Priority Data

Sep. 24, 2002 (IT) ..... PD2002A0246

(51) Int. Cl.
*A43B 7/06* (2006.01)

(52) U.S. Cl. ..... 36/3 B; 36/59 R

(58) Field of Classification Search ..... 36/3 B, 36/59 R, 12, 14, 25 R
See application file for complete search history.

(56) References Cited

U.S. PATENT DOCUMENTS

| | | | | |
|---|---|---|---|---|
| 3,383,782 | A | 5/1968 | McGinnity | |
| 4,043,058 | A | 8/1977 | Hollister et al. | |
| 6,477,789 | B2 | 11/2002 | Cheng | |
| 6,508,015 | B1 | 1/2003 | Rauch | |
| 7,367,141 | B2 * | 5/2008 | Polegato Moretti | 36/3 B |
| 2001/0003875 | A1 | 6/2001 | Moretti | |

FOREIGN PATENT DOCUMENTS

| | | |
|---|---|---|
| EP | 0 713 658 | 5/1996 |
| WO | 97/14326 | 4/1997 |
| WO | 98/51177 | 11/1998 |
| WO | 02/32246 | 4/2002 |

* cited by examiner

*Primary Examiner*—Ted Kavanaugh
(74) *Attorney, Agent, or Firm*—Oblon, Spivak, McClelland, Maier & Neustadt, L.L.P.

(57) ABSTRACT

A waterproof and breathable sole for shoes, having a structure including a supporting layer which, at least in a preset macroportion, is made of net, felt or other diffusely perforated material. A membrane made of a material that is impermeable to water and permeable to water vapor is associated above the supporting layer at least in the at least one preset macroportion made of net, felt or other diffusely perforated material, which it covers. A tread made of plastic material, with at least one through macroperforation at the at least one preset macroportion made of net, felt or other diffusely perforated material, is joined hermetically to the membrane and to the supporting layer at least at the perimeter of the at least one macroportion made of net, felt or other diffusely perforated material.

38 Claims, 4 Drawing Sheets

WATERPROOF AND BREATHABLE SOLE FOR SHOES

CROSS REFERENCE

This application is a continuation of and is based upon and claims the benefit of priority under 35 U.S.C. §120 for U.S. Ser. No. 10/529,187, filed Mar. 24, 2005, which is a National Stage of PCT/EP03/10395, filed Sep. 18, 2003, and claims the benefit of priority under 35 U.S.C. §119 from Italian Patent Application No. PD2002A000246, filed Sep. 24, 2002, the entire contents of each which are incorporated herein by reference.

BACKGROUND OF THE INVENTION

1. Field of the Invention

The present invention relates to an improved waterproof and breathable sole for shoes and to the shoe manufactured with such sole.

2. Description of the Related Art

Waterproof and breathable soles made of plastics for shoes are already known.

One of such soles is disclosed in WO 97/14326.

In this case, the sole comprises:

- a mid-sole with a membrane made of a material that is impermeable to water and permeable to water vapor, associated with a lower protective layer of a material that is resistant to hydrolysis, water-repellent, breathable and/or perforated;
- a tread made of perforated elastomer, which is joined perimetrically and hermetically to the mid-sole.

The waterproof and breathable sole disclosed in WO 98/51177 is also known; it comprises a preassembled insert in which there is a membrane that is impermeable to water and permeable to water vapor, associated with a lower protective layer made of a material that is resistant to hydrolysis, water-repellent, breathable and/or perforated.

The insert is completed by an element that is overmolded or over-assembled, surrounds the membrane and the protective layer, and is joined hermetically to them.

The insert is part of a mid-sole and is joined, together with said mid-sole, to a tread made of perforated plastic material, which is overmolded or over-assembled.

In both cases, the protective layer arranged below the membrane is designed to protect it against piercing due to foreign objects that have accidentally passed through the holes.

The protective layer is usually made of felt and is coupled to the membrane in a breathable manner (by means of spots of thermoplastic adhesive, for example of the polyurethane-based type) to allow the passage of the vapor from the inside of the shoe toward the outside through the holes provided in the tread.

Breathable and waterproof soles for shoes are also known from U.S. Ser. No. 09/978,634 and EPA No. 01124210.4 and comprise, at least along part of their extension, a lower waterproof component that constitutes the tread, an upper component with a supporting structure that is provided with holes connected to outlets at least on the upper and edge surfaces, and a waterproof vapor-permeable membrane that surrounds externally at least the outward-facing regions of the upper component.

The lower component, the upper component and the membrane are joined hermetically in the regions of possible internal water infiltration.

Although the above described soles have now been available commercially for years and are unanimously acknowledged as being capable of producing an exchange of heat and water vapor between the microclimate inside the shoe and the external microclimate, such soles, in some cases, such as for example use on the part of users with quantitatively higher-than-average foot perspiration, have been found to have a breathability that is insufficient to fully dispose of the generated vapor and ensure the correct microclimate inside the shoe.

The structure of the above described soles in fact has, at least in a downward region, layers of microperforated plastic material, i.e., provided with holes having a diameter on the order of 1-2 millimeters, and the total area of the microperforations in any case limits the area of the membrane that is actually affected by the exchange of heat and vapor.

SUMMARY OF THE INVENTION

The aim of the present invention is to provide a waterproof and breathable sole for shoes, and the corresponding shoe, having an improved structure that is capable of utilizing to the maximum extent the breathability of the membrane that is impermeable to water and permeable to water vapor.

Within this aim, an object of the invention is to provide a waterproof and breathable sole for shoes having a structure that allows to enlarge the area of the membrane until it affects substantially the entire sole of the foot.

Another object is to provide a sole that does not entail particular constructive complications with respect to conventional soles.

Another object is to provide a sole whose costs are competitive with respect to conventional types.

This aim and these and other objects that will become better apparent hereinafter are achieved by a waterproof and breathable sole for shoes having a structure that is characterized in that it comprises:

- a supporting layer which, at least in a preset macroportion, is made of net, felt or other diffusely perforated material;
- a membrane that is made of a material that is impermeable to water and permeable to water vapor and is associated above said supporting layer at least in said at least one preset macroportion made of net, felt or other diffusely perforated material, which it covers;
- a tread made of plastic material, with at least one through macroperforation at said at least one preset macroportion made of net, felt or other diffusely perforated material, said tread being joined hermetically to said membrane and to said supporting layer at least at the perimeter of said at least one macroportion made of net, felt or other diffusely perforated material.

BRIEF DESCRIPTION OF THE DRAWINGS

Further characteristics and advantages of the present invention will become better apparent from the detailed description of some embodiments thereof, illustrated by way of non-limitative example in the accompanying drawings, wherein.

DETAILED DESCRIPTION OF THE PREFERRED EMBODIMENTS

Figure 1:
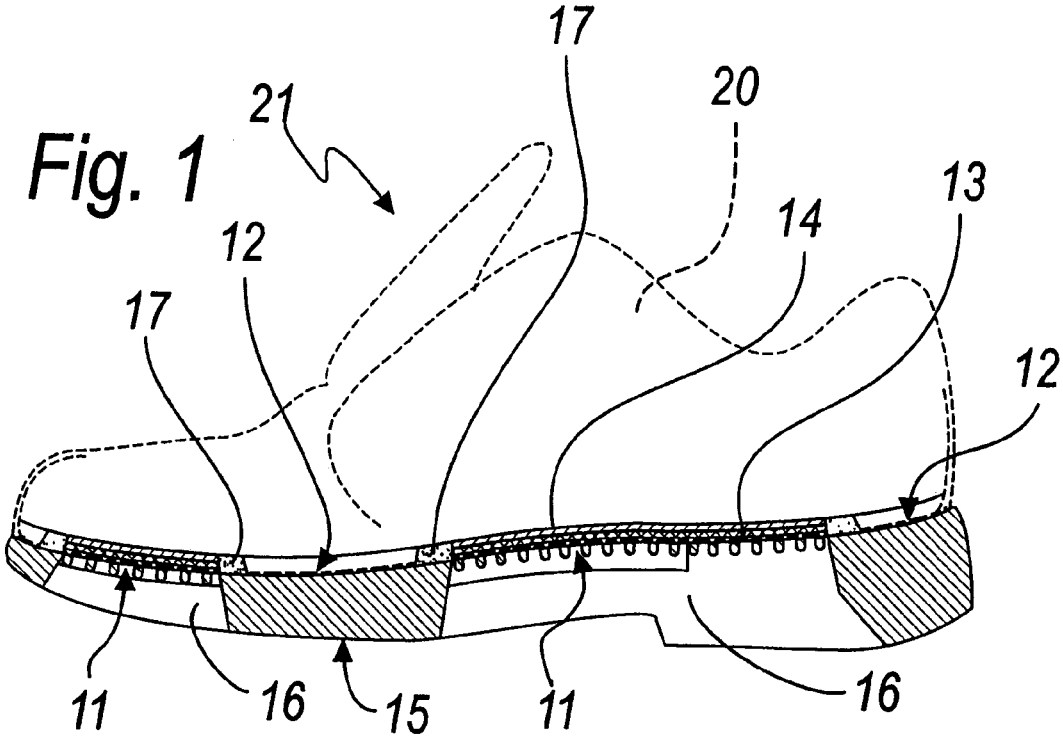
FIG. 1 is a longitudinal sectional view of a waterproof and breathable sole for shoes having the structure according to the invention, in a first embodiment.
Figure 2:
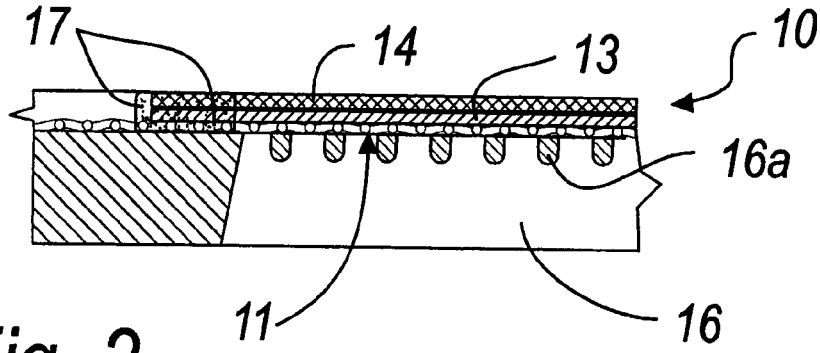
FIG. 2 is an enlarged-scale sectional view of a detail of the sole of FIG. 1.
Figure 3:
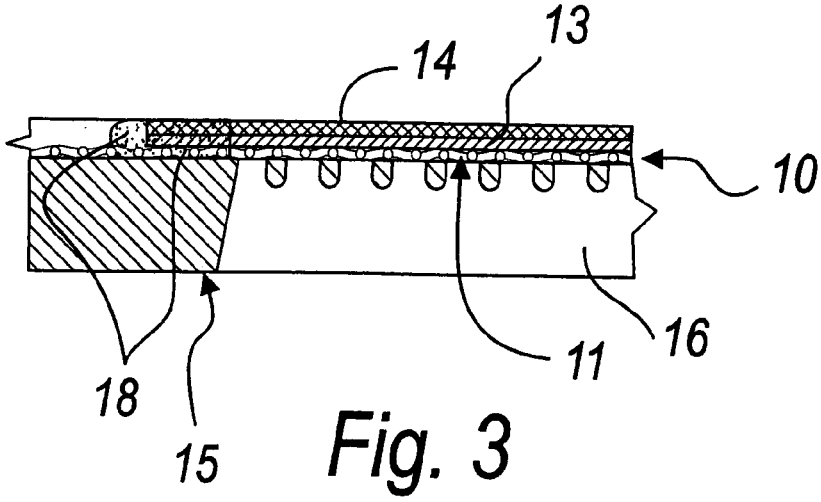
FIG. 3 is an enlarged-scale sectional view of a detail of a variation of the sole of FIG. 1.
Figure 4:
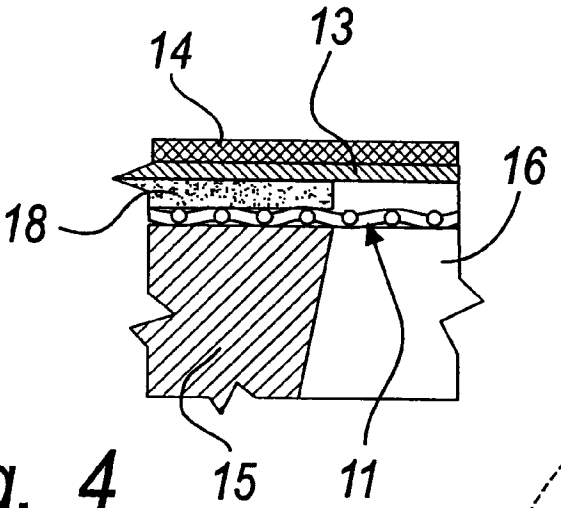
FIG. 4 is an exploded view of the components of the variation of FIG. 3.

With reference to FIGS. 1 to 4, a waterproof and breathable sole for shoes has, in a first embodiment, a structure that comprises a supporting layer 10 which is made of net, felt or other diffusely perforated material in preset macroportions 11.

The supporting layer 10 constitutes, in this case, the assembly insole of the shoe. The term "macroportion" is used to reference portions of area preferably on the order of at least one square centimeter.

In the other portions 12, the supporting layer 10 can be constituted by a fine mesh of synthetic material, leather or other commonly used materials. The structure also comprises a membrane 13, which is made of a material that is impermeable to water and permeable to water vapor (which is commonly commercially available and is made for example of expanded polytetrafluoroethylene), laminated onto a fine mesh 14 for supporting it, which lies above it, is made of synthetic material, and is arranged above the supporting layer 10 at at least the macroportions 11, which it covers.

The membrane 13 can be made of airtight material or of air-permeable material.

The membrane 13 can be coupled by means of spots of glue (not shown in the figures) to the supporting layer 10 in the regions of contact.

A tread 15 made of plastic material has through macroperforations 16 at the macroportions 11 and is joined hermetically to the membrane 13 and to the supporting layer 10 at least at the perimeters of the macroportions 11.

The through macroperforations 16 can be crossed by cross-members 16*a*, which prevent transverse deformations of the assembly by acting as tension members in the deformations that occur as a consequence of use.

The coupling (FIGS. 1 and 2) can be provided for example by means of a perimetric layer 17 of adhesive, which is spread so as to penetrate, when the components are joined, through the meshes of the net and join monolithically the tread 15 and the membrane 13.

As an alternative (FIGS. 3 and 4), it is possible to arrange between the supporting layer 10 and the membrane 13, or between the tread 15 and the supporting layer 10, a film 18 made of PVC or PU and then perform a high-frequency welding between the tread 15 and the membrane 13 by melting the film 18, with penetration thereof between the meshes of the net so as to join the components monolithically.

As a further alternative, it is possible to perform high-frequency welding of the layer 10 and the membrane 13 to the film 18 and then glue the assembly to the tread 15.

An inner sole, not shown in the figures, made of breathable or diffusely perforated material, for supporting the foot, can be arranged above the supporting layer 10 and the membrane 13 with the fine mesh 14.

The described sole can be applied, in the commonly known ways, to an upper 20 of any kind so as to constitute a shoe 21.

Figure 5:
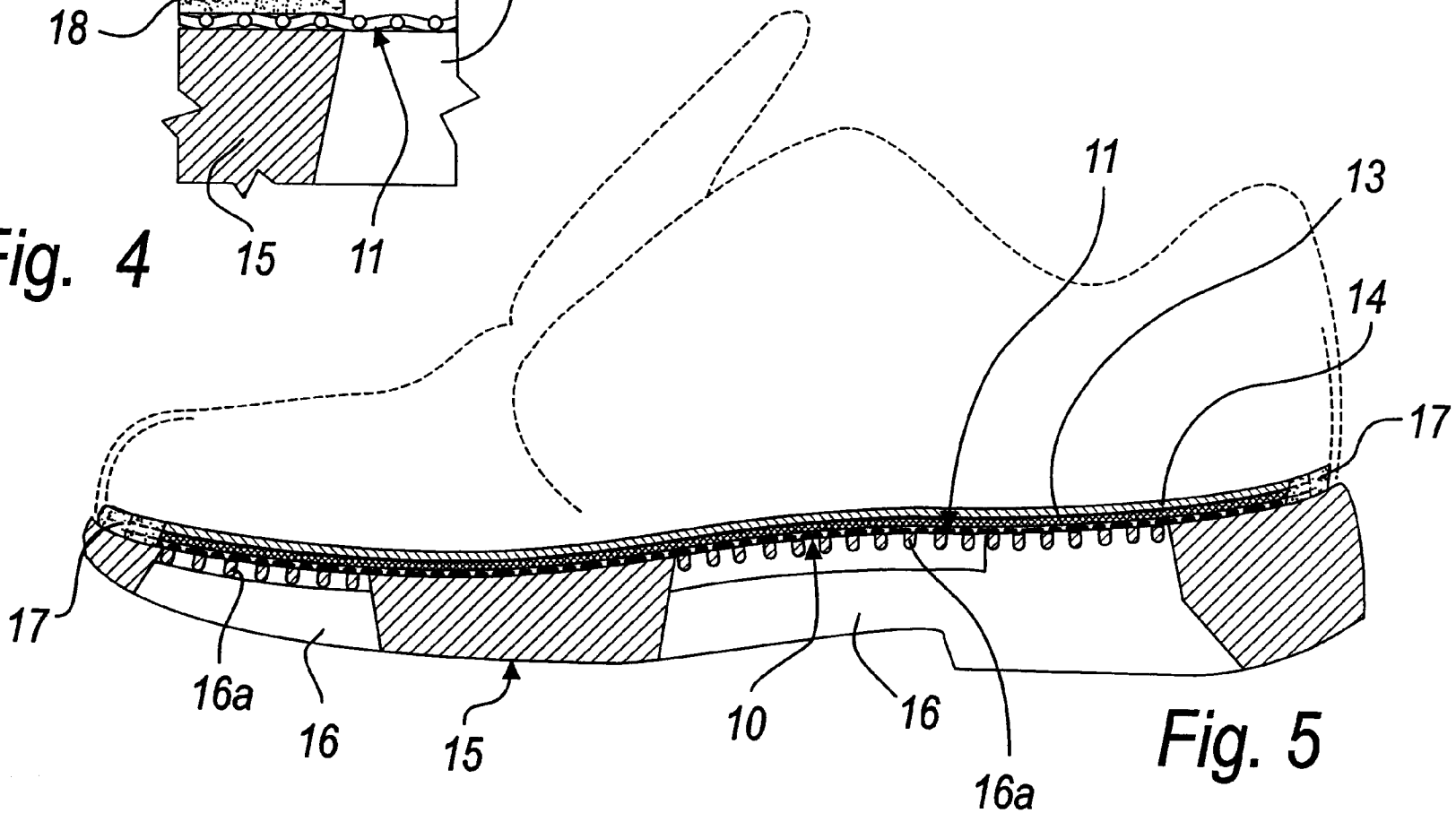
FIG. 5 is a sectional view, taken along a longitudinal plane, of a waterproof and breathable sole for shoes having the structure according to the invention in a constructive variation.
Figure 6:
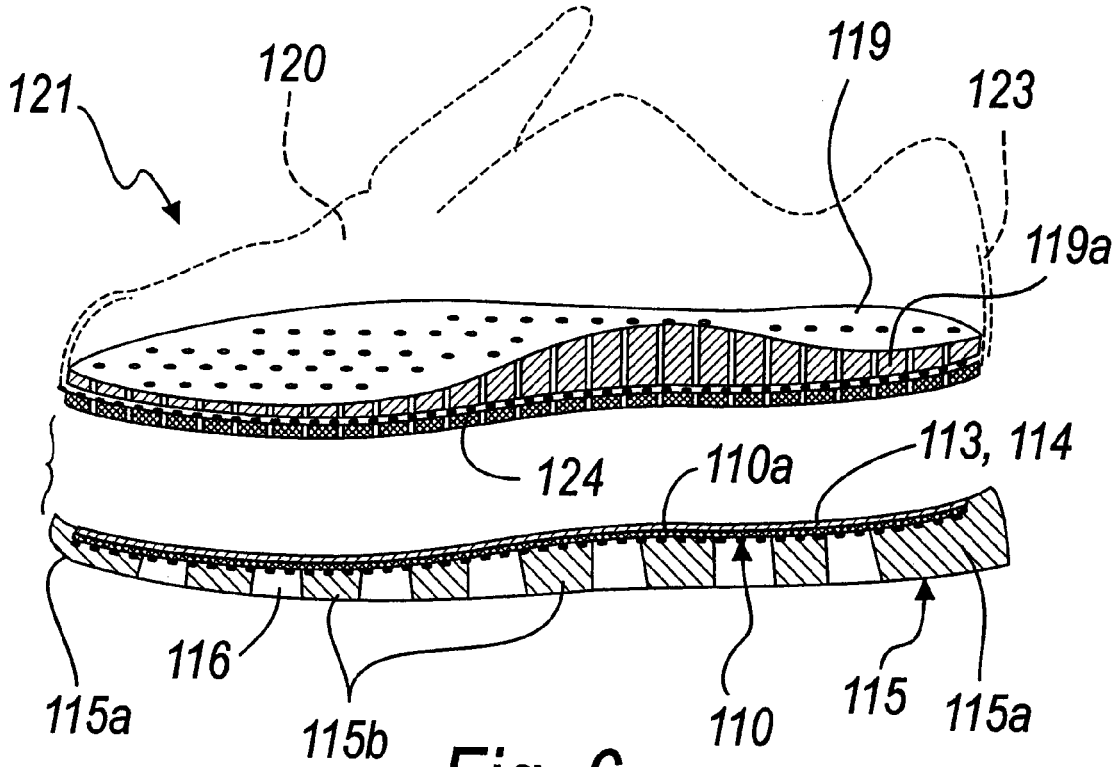
FIG. 6 is an exploded sectional view, taken along a longitudinal plane, of a waterproof and breathable sole for shoes having the structure according to the invention in a second embodiment thereof.
Figure 7:
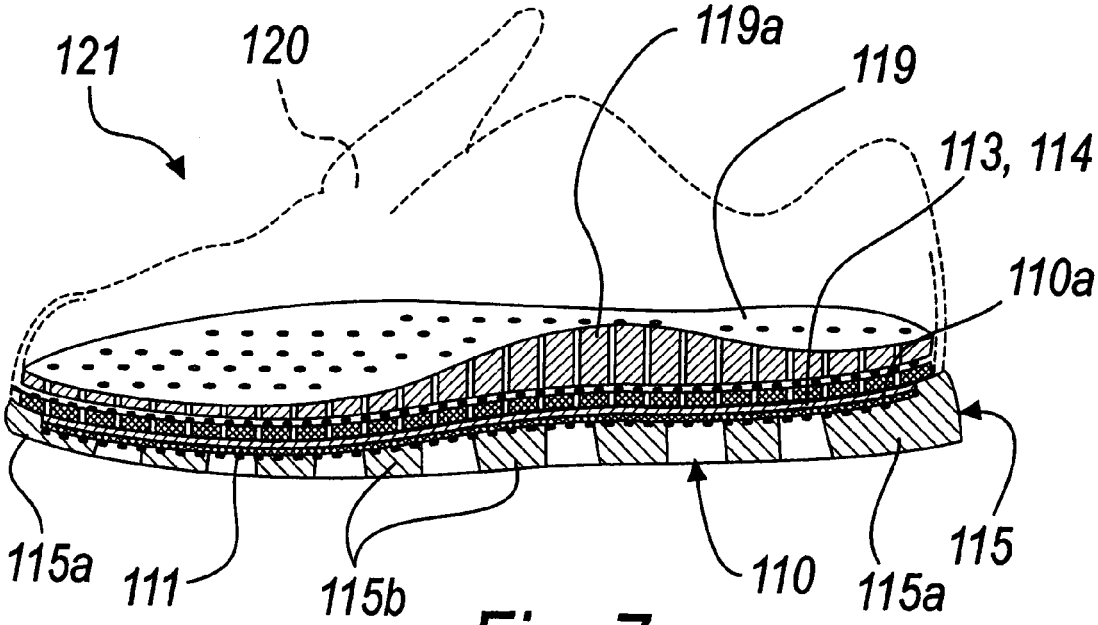
FIG. 7 is a sectional view, taken along a longitudinal plane, of the sole of FIG. 6 in the assembled condition.
Figure 8:
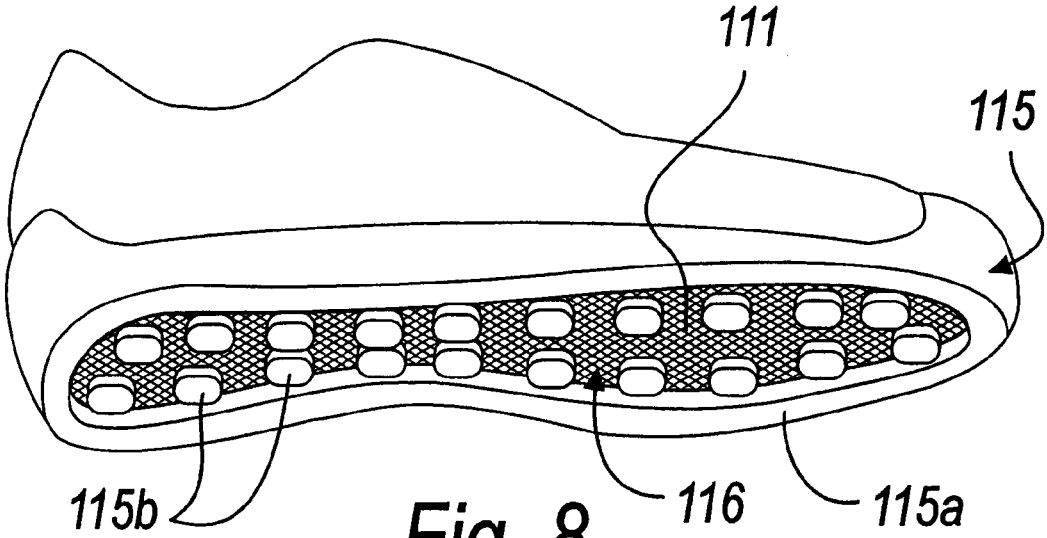
FIG. 8 is a bottom perspective view of a shoe provided with the sole of FIGS. 6 and 7.
Figure 9:
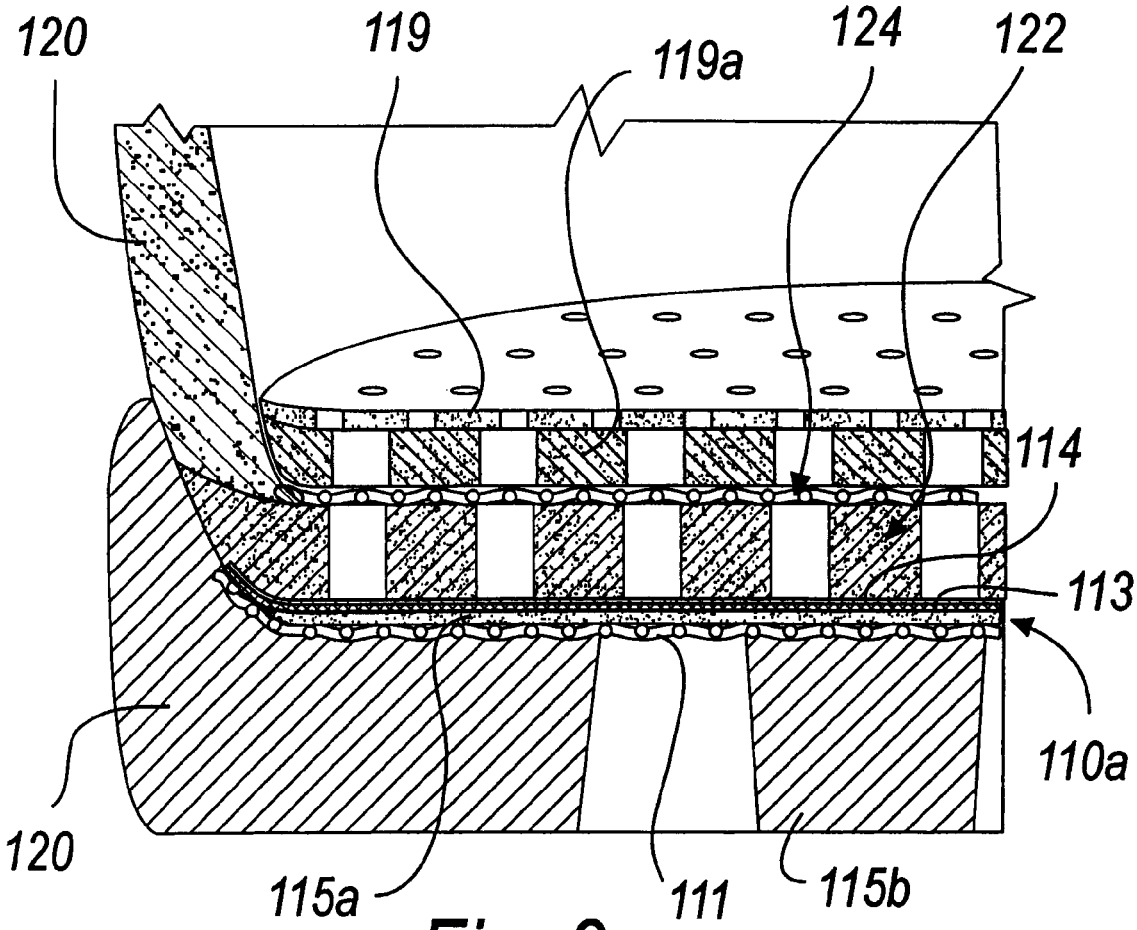
FIG. 9 is an enlarged-scale sectional view of a detail of FIG. 7.

With reference to FIG. 5, in a slightly different embodiment it is possible to provide a single macroportion 11 that affects the entire sole of the foot without portions 12, regardless of the arrangement of the through macroperforations 16 of the tread 15.

In this case, the membrane 13 and its support 14 also affect the entire sole of the foot.

The glue 17 or the film 18 are arranged perimetrically.

With reference now to FIGS. 6 to 9, a waterproof and breathable sole for shoes according to a second embodiment has a structure that comprises a supporting layer 110 that is completely made of net, felt or other diffusely perforated material, which accordingly constitutes a single large macroportion 111.

The sole again comprises a membrane 113 made of a material that is impermeable to water and permeable to water vapor (commonly commercially available and made for example of expanded polytetrafluoroethylene), laminated together with a fine mesh 114 for supporting it which lies above it, is made of synthetic material and is arranged above the supporting layer 110, which it covers completely.

The membrane 113 can be made of airtight material or air-permeable material.

The membrane 113 is preferably coupled by means of spots of glue to the supporting layer 110.

It is possible to arrange a protective layer 110*a*, made for example of felt, below the membrane 113, for example if the supporting layer is made of net.

A tread 115 made of plastic material is assembled to the supporting layer 110 and is joined hermetically to the membrane 113 at least at the peripheral region of said membrane.

The coupling can be provided by directly injecting the tread 115 onto the supporting layer 110 in a mold, with at least perimetric penetration through the meshes of the net or of the felt that is appropriately reduced in thickness at its perimeter, is perforated perimetrically or bordered with net so as to reach the membrane 113.

The tread 115 is provided so as to form macroperforations 116, for example a single large through macroperforation 116 that affects substantially all the sole of the foot, except for the perimeter 115*a*, which is interrupted by protrusions 115*b* that form, together with the perimeter 115*a*, the surface for contact with the ground.

The coupling between the tread 115 and the supporting layer 110 can be obtained also in the manners described in the first embodiment, i.e., by gluing or high-frequency welding.

The sole can be coupled to an upper 120, so as to provide a shoe 121 that is assembled on an assembly insole 124 and is optionally coupled in a downward region to a filler layer 122 made of an expanded material such as diffusely perforated EVA, coconut fibers, etcetera.

The layer 122, when it is made of diffusely perforated EVA or the like (therefore inherently waterproof but rendered air-permeable), can be used as a means for the perimetric hermetic high-frequency welding from above of the membrane 113 to the upper 120.

The subsequent gluing of the tread 115 need not necessarily be hermetic.

The coupling between the sole and the upper 120 is in the peripheral region of said assembly insole and is provided for example by gluing or high-frequency welding.

An inner sole 119 made of breathable or diffusely perforated material can be arranged above the assembly insole 124.

The inner sole 119 can also be coupled in a downward region to a shock-absorbing layer 119*a* made of polyethylene or the like, which is diffusely perforated and anatomically contoured.

Other layers, not shown, such as cleaning insoles, absorbent layers et cetera, can be provided.

In practice it has been observed that the intended aim and objects of the present invention have been achieved.

A waterproof and breathable sole for shoes has in fact been provided whose structure is capable of utilizing to the fullest extent the breathability of the waterproof vapor-permeable membrane.

The structure allows to enlarge the area of the membrane until it affects substantially the entire sole of the foot.

The manufacture of the sole does not entail particular constructive complications with respect to conventional soles.

The invention thus conceived is susceptible of numerous modifications and variations, all of which are within the scope of the appended claims.

All the details may further be replaced with other technically equivalent elements.

In practice, the materials, so long as they are compatible with the contingent use, as well as the dimensions, may be any according to requirements.

Obviously, numerous modifications and variations of the present invention are possible in light of the above teachings. It is therefore to be understood that within the scope of the appended claims, the invention may be practiced otherwise than as specifically described herein.

The invention claimed is:

1. A waterproof and breathable sole for shoes comprising:

a supporting layer which includes a plurality of macroportions having an area on the order of at least one square centimeter;

a membrane that is made of a material that is impermeable to water and permeable to water vapor and is associated above said supporting layer at least in said plurality of macroportions;

a tread made of plastic material, said tread including a plurality of macroperforations extending through the tread, wherein said plurality of macroperforations are beneath and in communication with said plurality of macroportions, wherein said plurality of macroperforations of said tread exposes said area on the order of at least one square centimeter of said supporting layer to outside of said tread; and wherein said tread is hermetically sealed to said membrane and to said supporting layer about a periphery of each macroportion.

2. The sole according to claim 1, wherein said plurality of macroportions are made of mesh, net, felt or other diffusely perforated material.

3. The sole according to claim 2, further comprising a perimetric layer of glue spread onto said supporting layer so as to penetrate through the meshes of the net or the felt and join monolithically and hermetically the lower tread and the upper membrane.

4. The sole according to claim 1, wherein said membrane made of waterproof and vapor-permeable material is laminated together with a fine supporting mesh, which lies thereabove and is made of synthetic material.

5. The sole according to claim 1, wherein said membrane is coupled by way of spots of glue to said supporting layer.

6. The sole according to claim 1, wherein said supporting layer is entirely made of net, felt or other diffusely perforated material.

7. The sole according to claim 1, wherein one or more protrusions are positioned at least partially within said plurality of macroperforations, and further wherein said one or more protrusions form, together with a perimeter of the sole, a ground contact surface.

8. The sole according to claim 1, wherein said tread is provided injected directly into a mold onto said supporting layer with at least perimetric penetration through the supporting layer to the membrane to hermetically join the tread and the membrane about the periphery of each macroportion.

9. A shoe with a sole as set forth in claim 1, further comprising: an upper that is assembled to an assembly insole and is coupled to said sole at a peripheral region of said insole.

10. The sole according to claim 1, wherein the supporting layer includes a mesh, and wherein the tread is hermetically joined to said membrane through the mesh about the perimeter of each macroportion.

11. The sole according to claim 10, wherein the tread penetrates through meshes of the supporting layer.

12. The sole according to claim 1, further including a layer positioned above the membrane which supports the membrane.

13. The sole according to claim 12, wherein the layer positioned above the membrane is a fine mesh.

14. The sole according to claim 1, further comprising:

a film made of PVC or PU arranged either between the supporting layer and the membrane or between the tread and the supporting layer, with high frequency welding performed so as to melt the film and make it penetrate the mesh, so as to join the membrane and the tread monolithically.

15. The sole according to claim 1, further comprising:

a film made of PVC or PU arranged between said supporting layer and said membrane by high-frequency welding and the assembly is then glued to said tread.

16. The sole according to claim 1, wherein the tread is coupled to the membrane by an adhesive that penetrates perimetric portions of the supporting layer to hermetically join the tread to the membrane about each macroportion.

17. The shoe according to claim 1, wherein a welded film extends through perimetric portions of the supporting layer to hermetically join the tread and the membrane about each macroportion.

18. The sole according to claim 11, wherein the supporting layer includes a net at border portions through which said tread penetrates.

19. The sole according to claim 1, further including a protective layer positioned above the supporting layer.

20. The sole according to claim 1, wherein the supporting layer is permeable to water, and wherein the hermetic sealing of the membrane to the tread provides a hermetically sealed region which isolates an inside of the sealed region from an outside of the sealed region such that water cannot pass through the supporting layer to an interior of the shoe.

21. A waterproof and breathable sole for shoes comprising:

a supporting layer which includes a plurality of macroportions having an area on the order of at least one square centimeter;

a membrane that is made of a material that is impermeable to water and permeable to water vapor, and wherein the membrane is located above said supporting layer at least in said plurality of macroportions;

a tread, said tread including a plurality of macroperforations extending through the tread, wherein said macroperforations are beneath and in communication with said macroportions, and wherein said macroperforations of said tread exposes said area on the order of at least one square centimeter of said supporting layer to outside of said tread;

at least one support member positioned inside of the macroperforations, wherein said at least one support member is coupled to said supporting layer, wherein the tread is hermetically sealed to said membrane about a periphery of the plurality of macroportions.

22. A shoe according to claim 21, wherein said plurality of macroportions are made of net, felt or other diffusely perforated material.

23. A shoe according to claim 21, further including a layer positioned above the membrane for supporting the membrane.

24. A shoe according to claim 21, wherein the supporting layer includes a mesh, and wherein for each macroportion the tread is hermetically coupled to said membrane through the mesh about a perimeter of said macroportion.

25. A shoe according to claim 24, wherein a welded film extends through perimetric portions of the supporting layer to hermetically join the tread and the membrane about each macroportion.

26. A shoe according to claim 21, wherein the tread is injected onto the supporting layer so as to penetrate perimetric portions of the supporting layer and hermetically join the tread to the membrane about each macroportion.

27. The sole according to claim 26, wherein the tread penetrates through meshes of the supporting layer.

28. The sole according to claim 26, wherein the supporting layer includes a net at border portions through which said tread penetrates.

29. The sole according to claim 26, wherein the supporting layer is perimetrically reduced in thickness to allow the tread to hermetically join the membrane.

30. A shoe comprising:

a sole that comprises:

a supporting layer which includes at least one macroportion having an area on the order of at least one square centimeter;

a membrane, which is made of a material that is impermeable to water and vapor-permeable and is associated above said supporting layer at least in said at least one macroportion;

a tread, which is made of plastic material, said tread including at least one macroperforation extending through said tread, wherein said at least one macroperforation is beneath and in communication with said at least one macroportion, and wherein said at least one macroperforation of said tread exposes said area on the order of at least one square centimeter of said supporting layer to outside of said tread;

an upper that is assembled on an assembly insole that is coupled to a layer made of a diffusely perforated material, which provides a means for hermetic sealing of said membrane to said upper from above, perimetrically with respect to said macroportion, said tread being glued perimetrically to the assembly.

31. The shoe according to claim 30, wherein said at least one macroportion is made of net, felt or other diffusely perforated material.

32. The shoe according to claim 30, wherein the supporting layer is permeable to water.

33. The shoe according to claim 30, wherein the membrane is continuous along the length of the shoe.

34. The shoe according to claim 30, wherein the hermetic sealing prevents water from flowing around the membrane.

35. The shoe according to claim 30, wherein the supporting layer includes a plurality of macroportions.

36. The sole according to claim 30, wherein said membrane made of waterproof and vapor-permeable material is laminated together with a fine supporting mesh, which lies thereabove and is made of synthetic material.

37. The sole according to claim 30, further including a protective layer positioned above the supporting layer.

38. The sole according to claim 30, wherein the supporting layer is permeable to water, and wherein the hermetic sealing of the membrane to the upper provides a hermetically sealed region which isolates an inside of the sealed region from an outside of the sealed region such that water cannot pass through the supporting layer to an interior of the shoe.

* * * * *